US008960305B2

(12) United States Patent
McCann et al.

(10) Patent No.: US 8,960,305 B2
(45) Date of Patent: Feb. 24, 2015

(54) MONITORING SYSTEM FOR PIPELINES OR RISERS IN FLOATING PRODUCTION INSTALLATIONS

(75) Inventors: Dominic McCann, Romsey (GB); Daniel Sack, Perth WA (AU); Morten Stenhaug, Sandsll (NO)

(73) Assignee: Schlumberger Technology Corporation, Sugar Land, TX (US)

( * ) Notice: Subject to any disclaimer, the term of this patent is extended or adjusted under 35 U.S.C. 154(b) by 450 days.

(21) Appl. No.: 12/811,650

(22) PCT Filed: Jan. 7, 2009

(86) PCT No.: PCT/GB2009/000025

§ 371 (c)(1),
(2), (4) Date: Jan. 10, 2011

(87) PCT Pub. No.: WO2009/087371

PCT Pub. Date: Jul. 16, 2009

(65) Prior Publication Data

US 2011/0088910 A1 Apr. 21, 2011

(30) Foreign Application Priority Data

Jan. 8, 2008 (GB) ..... 0800241.2

(51) Int. Cl.
*E21B 7/12* (2006.01)
*E21B 19/00* (2006.01)
*E21B 17/01* (2006.01)

(52) U.S. Cl.
CPC ..... *E21B 19/002* (2013.01); *E21B 17/01* (2013.01); *E21B 19/004* (2013.01)
USPC ..... 166/356; 166/344; 166/302

(58) Field of Classification Search
USPC ..... 166/367, 336, 380, 344
See application file for complete search history.

(56) References Cited

U.S. PATENT DOCUMENTS 3,149,492 A * 9/1964 Weinberg ..... 73/724
3,504,741 A * 4/1970 Talley, Jr. et al. ..... 166/356

(Continued)

FOREIGN PATENT DOCUMENTS

EP 1635034 A1 6/2009
GB 2456300 B 7/2009

(Continued)

OTHER PUBLICATIONS

International Preliminary Report on Patentability and Written Opinion for PCT/GB2009/000025 dated Jul. 13, 2010.

(Continued)

*Primary Examiner* — Matthew Buck
*Assistant Examiner* — Aaron Lembo
(74) *Attorney, Agent, or Firm* — Chamberlain Hrdlicka

(57) ABSTRACT

A method of monitoring a subsea pipeline system connecting one or more wells to a floating production system, wherein the pipeline system is at least partially flexible, the method comprises installing a continuous optical fiber distributed sensor as part of the pipeline system, the sensor capable of providing a distributed measurement of temperature, vibration, pressure or strain, or any combination thereof; using the sensor to obtain a distributed measurement of temperature, vibration, pressure and/or strain along at least part of the pipeline system indexed to a length thereof; and using the distributed measurement to predict the actual condition of the fluid, the pipeline system and/or the adjacent sea water using a model. A subsea pipeline system for connecting one or more wells to a floating production system, wherein the pipeline system comprises at least one partially flexible pipeline; a continuous optical fiber distributed sensor installed as part of the pipeline capable of providing a distributed measurement of temperature and/or strain; means for obtaining a distributed measurement of temperature, vibration or strain, or combinations thereof, along at least part of the pipeline system indexed to a length thereof from the sensor; and means for using the distributed measurement to manage operation of the system. Preferably, the system comprises means for modelling expected pipeline behavior using the distributed measurement as an input; and means for using the modelled behavior to manage operation of the system.

13 Claims, 2 Drawing Sheets

(56) References Cited

U.S. PATENT DOCUMENTS

| | | | | |
|---|---|---|---|---|
| 3,643,736 | A * | 2/1972 | Talley, Jr. | 166/356 |
| 5,570,437 | A | 10/1996 | Kluth et al. | |
| 5,730,219 | A * | 3/1998 | Tubel et al. | 166/250.1 |
| 5,732,776 | A * | 3/1998 | Tubel et al. | 166/250.15 |
| 5,845,033 | A | 12/1998 | Berthold et al. | |
| 6,386,290 | B1 * | 5/2002 | Headworth | 166/346 |
| 6,601,458 | B1 * | 8/2003 | Gysling et al. | 73/861.04 |
| 6,612,370 | B1 | 9/2003 | Jahnsen et al. | |
| 6,772,840 | B2 * | 8/2004 | Headworth | 166/302 |
| 7,793,726 | B2 * | 9/2010 | Daniel et al. | 166/367 |
| 2003/0056954 | A1 * | 3/2003 | Headworth | 166/302 |
| 2004/0035216 | A1 | 2/2004 | Morrison et al. | |
| 2004/0206187 | A1 | 10/2004 | Williams et al. | |
| 2005/0100414 | A1 | 5/2005 | Salama et al. | |
| 2007/0193363 | A1 | 8/2007 | Allen et al. | |
| 2007/0227741 | A1 | 10/2007 | Lovell et al. | |
| 2007/0284112 | A1 | 12/2007 | Magne et al. | |
| 2011/0229099 | A1 | 9/2011 | Hartog | |

FOREIGN PATENT DOCUMENTS

| | | | |
|---|---|---|---|
| WO | 99/64781 | A | 12/1999 |
| WO | 00/00799 | A | 1/2000 |
| WO | 2004/007910 | A | 1/2004 |
| WO | 2004/018966 | A1 | 3/2004 |
| WO | 2006/003208 | A | 1/2006 |
| WO | 2006/050488 | A1 | 5/2006 |
| WO | 2007/059026 | A | 5/2007 |

OTHER PUBLICATIONS

International Search Report in PCT/GB2009/000025.

Intellectual Property of UK Patents Act 1977: Search Report Under Section 17.

Brown, G. A. "Monitoring Muilti-layered Reservoir Pressures and GOR Changes Over Time Using Permanently Installed Distributed Temperature Measurements", SPE 101886, Sep. 2006.

* cited by examiner

MONITORING SYSTEM FOR PIPELINES OR RISERS IN FLOATING PRODUCTION INSTALLATIONS

CROSS-REFERENCE TO RELATED APPLICATIONS

The present Application is a US national phase of PCT/GB2009/000025 filed on Jan. 7, 2009 ("PCT Application"), which claims priority from Great Britain Application No. GB0800241.2 filed on Jan. 8, 2008, all of which are hereby incorporated by reference in their entirety into the present Application.

TECHNICAL FIELD

This invention relates to monitoring systems for use in floating production installations such as those used in offshore oil and gas production. In particular, the invention relates to the use of distributed fibre optic sensors to provide information allowing effective management of such production systems.

BACKGROUND ART

Subsea oil and gas production is growing in importance and is expected to increase significantly in the next 5 to 10 years. In addition, offshore fields are being exploited in deeper and deeper water depths. Floating Production, Storage and Offloading (FPSO) systems are sometimes used to collect the oil and/or gas produced by one or more wells or platforms in an offshore field, process it and store it until it can be offloaded into a tanker or pipeline for transport to land-based facilities. One common approach to FPSOs is to use a decommissioned oil tanker which has been stripped down and re-equipped with facilities to be connected to a mooring buoy and to process and store oil delivered from the wells or platforms. The oil and/or gas is delivered from the well or platform to the FPSO by means of risers, flowlines or export lines connected through a mooring buoy.

Oil and gas production using a FPSO presents many challenges which increase as the water depth increases. For instance, one problem is that the lines used to transfer the oil or gas from a wellhead situated on the seabed to the FPSO are subject to tidal and water current movements and to motions associated with the effects of sea conditions on the FPSO, and therefore can suffer from fatigue or damaging vibrations. Another problem is that the temperature of the oil or gas in the line can change as flow conditions in the line change. As a result at low temperatures, waxes or hydrates can be deposited on the inside of the lines. This is a serious problem especially when, oil or gas production is stopped during shut-in periods. Then the temperature of the oil or gas in the line will cool as a result of heat loss to the surrounding much cooler sea water. In order to prevent hydrates from forming in the lines, some operators have been heating the lines during shut-in periods which are rather costly. Others have been keeping shut-in times too short making maintenance inefficient.

Previous attempts to address these issues have involved modelling of the expected flow-line behaviour and using the results of the modelling to determine insulation and/or heating requirements of the line or maintenance schedules to minimize structural issues. However, these models make many assumptions about the environmental conditions and the pressure and temperature cycles, and in order to reduce the probability of system failure, conservative values or value ranges are applied. This results in costly inefficiencies, overly conservative behaviour and higher running costs. For example, flowlines are often insulated and/or heated to higher temperatures than are necessary which results in additional running costs. Furthermore, shut-in periods are often reduced in time, making it difficult to achieve critical maintenance in one shut-in.

Optical interrogation of fibres is a technology that has been available for many years and there are several commercial applications. In particular, Distributed Temperature Sensing (DTS) which makes use of the Raman backscattered Stokes and anti-Stokes wavelengths (see Brown, G. A. "Monitoring Multi-layered Reservoir Pressures and GOR Changes Over Time Using Permanently Installed Distributed Temperature Measurements", SPE 101886, September 2006) can provide a distributed temperature measurement along the fibre. This has been used in fire detection applications, power line monitoring and downhole applications. It has also been used on a flexible riser on the subsea platforms or flexible risers connected to an FPSO. Other known techniques for optical interrogation of fibres are the Brillouin and coherent Rayleigh noise (CRN) measurements.

The present invention provides an improved method and system for monitoring the behaviour of subsea lines, such as risers or pipelines. The invention employs distributed measurements with modelling to provide continuous and distributed prediction of subsea line behaviour.

DISCLOSURE OF INVENTION

A first aspect of the invention provides a method of monitoring subsea lines connecting one or more wells to a floating production system. The subsea lines can be of many different types. Preferred subsea lines are those that are partially or wholly flexible or compliant, and most preferred are compliant-type subsea lines. However, preferably the subsea lines or line system is at least partially flexible or compliant, the method comprising:

- installing a continuous optical fibre distributed sensor as part of the pipeline system, the sensor capable of providing a distributed measurement of temperature, vibration or strain, or combinations thereof;
- using the sensor to obtain a distributed measurement of temperature, vibration and/or strain along at least part of the pipeline system indexed to a length thereof;
- using the distributed measurement to predict the actual condition of the fluids, the pipeline system and/or the adjacent sea water using a model.

It is preferred that the method comprises modelling expected pipeline behaviour using the distributed measurement as an input; and using the modelled behaviour to manage operation of the system.

Preferably, the model estimates fatigue in the pipeline system, and/or the likelihood of hydrate or wax deposits at locations in the pipeline system.

The modelled behaviour can be used to determine operation control parameters of the system, including heating zones of the pipeline system, shut-down/cool-down periods, choke positions and tension in anchor chains.

The method can also include making discrete measurements such as flow rate measurements in the pipeline and/or at the surface on the floating production system and using these to predict the actual condition of the fluid, the pipeline system and/or the adjacent sea water.

Preferably the step of installing a continuous optical fibre distributed sensor comprises embedding the fibre in the wall of the pipeline, fixing the fibre to the inner or outer wall of the pipeline, or locating the fibre in a conduit in the pipeline.

The method can comprise using Raman measurements to obtain a distributed temperature measurement, Brillouin backscatter measurements to obtain distributed strain and temperature measurements, and/or coherent Rayleigh noise to obtain distributed vibration measurements.

The methods according to the invention can be used in flow assurance programmes and marine structural integrity programmes. The measurements can be linked to the models for prediction and control in real-time.

A second aspect of the invention comprises a subsea pipeline system for connecting one or more wells to a floating production system, wherein the pipeline system comprises:

at least one partially flexible or compliant pipeline;

a continuous optical fibre distributed sensor installed as part of the pipeline capable of providing a distributed measurement of temperature and/or strain;

means for obtaining a distributed measurement of temperature, vibration or strain, or combinations thereof, along at least part of the pipeline system indexed to a length thereof from an output of the sensor; and means for using the distributed measurement to manage operation of the system.

Preferably, the system comprises means for modelling the expected pipeline behaviour using the distributed measurement as an input, and means for using the modelled behaviour to manage operation of the system.

The pipeline is typically a flexible or compliant riser or subsea flowline.

The optical fibre sensor can use Raman backscattered Stokes and anti-Stokes measurements for temperature determination, Brillouin backscatter for temperature and strain determination, or coherent Rayleigh noise for vibration monitoring.

The optical fibre may further be deployed in a U-shaped configuration with both ends located at or near the surface end of the pipeline. The fibre can be embedded in the wall of the pipeline, fixed to the inner or outer wall of the pipeline, or located in a conduit in the pipeline.

BRIEF DESCRIPTION OF FIGURES IN THE DRAWINGS

MODE(S) FOR CARRYING OUT THE INVENTION

Figure 1:
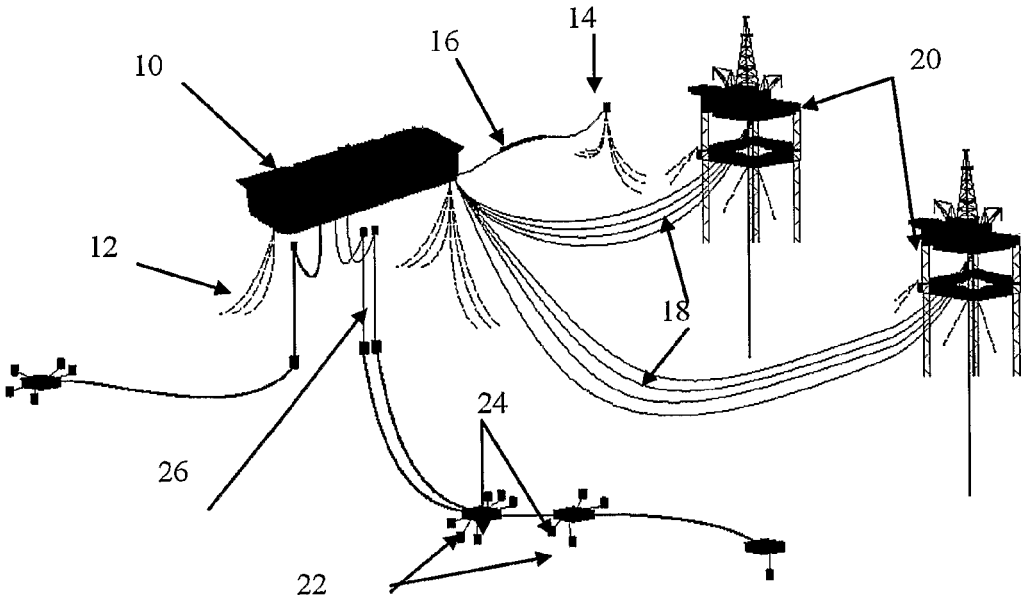
FIG. 1 shows a schematic view of a FPSO system.

The present invention provides methods and systems that address the problems indicated above in relation to prior art systems and other issues that can be prevented or better managed by continuous and distributed monitoring of the risers and/or pipeline. The invention can provide both continuous flow assurance and structural monitoring with feed back of measured parameters into original design models in order to manage operations. A schematic FPSO system is shown in FIG. 1 and comprises the FPSO vessel 10 which is anchored to the sea bed by anchor chains 12. A tanker offloading buoy 14 is connected to the FPSO 12 by means of a flexible offloading pipeline 16. Further flexible flowlines 18 connect the FPSO 10 to nearby platforms 20 to allow direct production to the FPSO 10. Also, existing subsea wells 22 have connections to subsea manifolds 24 from which flexible flowlines 18 and risers 26 lead to connect to the FPSO 10.

This invention proposes the use of fibre optics to provide a distributed measurement system which is used to calibrate models so that system behaviour is more accurately predicted thus removing the uncertainty of present day practices so that operations can be optimized. The system may also incorporate discrete measurements on the risers or pipelines, for example, fibre Bragg gratings and surface fluid flow rates. It is the combination of these measurements and system models which provide a methodology which is particularly preferred.

The combination of these measurements with feed back into design models will allow the following the following example diagnosis:

For flow assurance:

Assess burial of the lines and contribution to insulation;

Assess insulation performance;

Determine cold points;

Optimize process operations/heating requirements during shut-down/cool-down periods;

Optimize the time required for such shut-down/cool-down periods;

Determine hydrate blockage location;

Determine hydrate/wax inhibitor quantities and flow rates;

Determine deposits (wax, scales) location due to local abnormal pressure, temperature and/or strain profiles; and/or Slugging flow in the line detected through vibrations or dynamic strain measurements.

For marine/structural integrity:

Determine effect of shut down and/or pressure cycles on line stresses/movements, e.g., 'pipe walking' effect for injection lines and lateral buckling for production lines.

Assess riser and line fatigue.

Assess free span & upheaval buckling.

Assess vortex induced vibrations (VIV).

Potentially assess corrosion through strain profile changes.

These are just examples of system diagnoses which are possible.

There are further preferred aspects of this invention which are described below.

An optical fibre is preferably deployed along the length of the riser or pipeline. This can be achieved by embedding it within the wall of the pipeline or by strapping/clamping it to the inner or outer wall of the line. Another possible deployment mechanism is to provide a control line or conduit within the wall of the pipeline or again strapped to the inner or outer wall of the line. Once the riser or pipeline is deployed, the fibre can be pumped into this control line so that the fibre traverses the length of the line. The method is described in U.S. Pat. No. 5,570,437. If the fibre is to be used to measure strain in the line then it will need to be mechanically coupled to the riser or pipeline so that strain on the line is transferred to the fibre.

Figure 2:
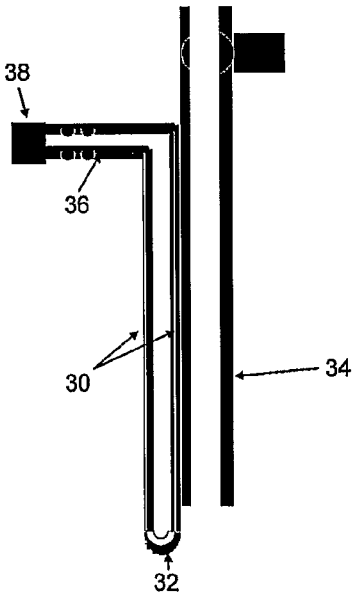
FIG. 2 shows an installation of an optical fibre sensor.

In one aspect of the invention, the control line is a continuous 'U' as shown schematically in FIG. 2. In this case, a pair of conduits 30 are provided, connected at their lower ends by a turn around sub 32 and attached to the inner or outer wall of the pipeline 34 (or disposed within the wall of the pipeline 34). The fibre 36 may be pumped in one end of the conduit 30, along its length and then all the way back so that both ends of the fibre are available at the FPSO 38 and can be interrogated by pulsing light down either side. This provides more accuracy when it is used for distributed temperature measurement and can also provide redundancy should the fibre break at some point. Finally, many flow-lines already have fibres installed within them for data transmission purpose. These fibres are generally single mode fibres and one embodiment of this invention is to interrogate such fibres using Brillouin scattering so that the temperature and strain can be measured along the fibre. This provides a retrofit methodology allowing the system to be applied to existing infrastructure. The same fibre can be used for distributed temperature, strain, vibration and dynamic strain measurements. Also, existing fibre lines used for communication could also be used for sensing purposes for example by interrogating them at a different wavelength or wavelengths from the ones used for communications; such different wavelength being suitable for sensing purposes.

The installed fibre can be interrogated using either Raman DTS for temperature distribution, Brillouin backscatter for temperature and strain or coherent Rayleigh noise for vibration monitoring, or any combination of these measurements. A high frequency Brillouin system can be used to provide a dynamic strain measurement. These distributed measurements can be combined with single point electric or fibre measurements of temperature, strain, flow, pressure or other parameters which can be relevant to determining the status of the system.

Figure 3:
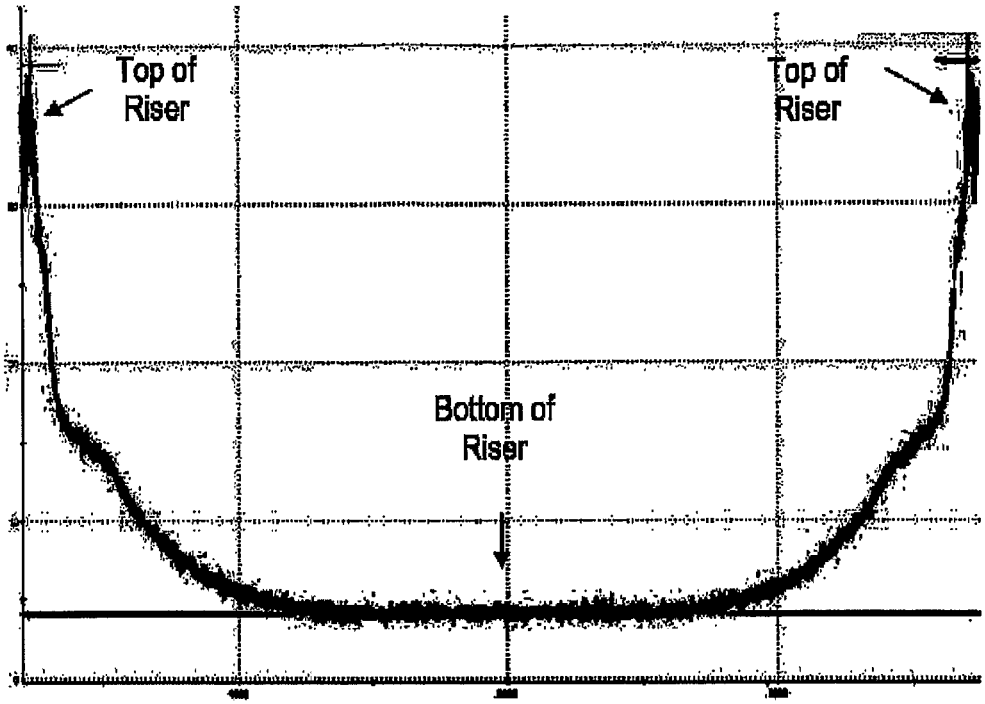
FIGS. 3 and 4 show distributed temperature measurements in a pipeline.
Figure 4:
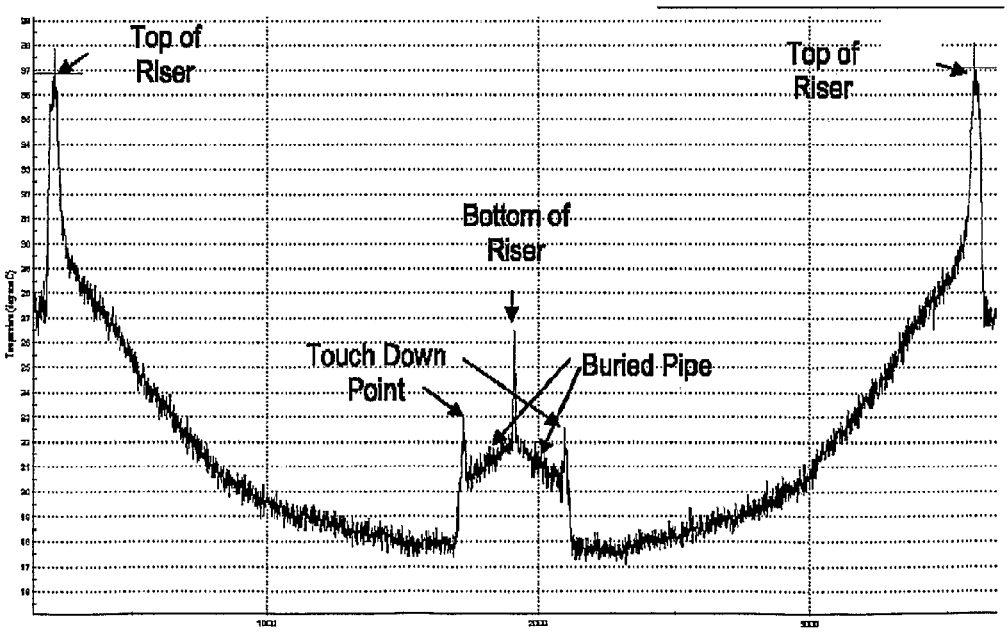

Interpretation that includes models calibrated using the measured data can be used to predict the status of the system. However, the measurements in themselves can be extremely useful in optimizing the system. A particular example is shown in FIGS. 3 and 4. These plots show the temperature along a flexible riser from surface at length 0 to the bottom of the line at the centre of the plot and back to surface as shown. FIG. 3 shows the temperature along a flexible riser before the heating elements on the line are switched on. Fluid is being pumped through the line but the line temperature is not controlled.

On the other hand, FIG. 4 shows the temperature along the line while fluid is being pumped in the line and once the heating elements are switched on. The plot clearly shows the point at with the flexible riser 'touches down' on the seabed and is partially or totally buried. From this point on the line to the lower point of the riser, the temperature increases due to the fact that heat loss to the seawater from this point onwards is reduced. The use of this data allows the heating of this part of the line to be reduced without risking its temperature being below a point where hydrates will form. By segmenting the line into sections and using the measured temperature along these sections, the heating of each section can be controlled to optimize the line temperature and thus reduce power required and reduce the running costs of the system. A few degrees of heating on such lines can represent a significant cost. The data can also be used to manage the shut-down/cool-down period, thus improving the efficiency of maintenance activities and allowing more to be achieved during a single shut-down.

The results from the measurements and interpretations are used to control system parameters such as riser heating as described above. Another example of an operational parameter that can be managed in this way is the tensioning of the anchor chains to control excessive vibration of the riser.

The modelling and interpretation can be performed on the FPSO or data from the measurements can be transmitted to a remote control centre which can be anywhere in the world. Such a centre can receive data from many installations potentially worldwide and undertake analysis of the information and model outputs. This will allow determination of the actions to be taken as a result of the model outputs. In some cases these actions can be automated.

One example is using an existing flow assurance model such as the well-known OLGA flow assurance model which uses pressure and temperature data to predict the likelihood of hydrate or wax formation in the line. The present invention system and method provides for collecting a plurality of temperature and pressure data along the entire or selected portions of the conduit using a distributed fibre sensor, feeding these data into a model to accurately predict the location of any possible hydrates and wax formation along the pipeline and taking localized corrective action as needed. For example, in a conduit comprising a plurality of heating elements selectively activating certain elements to control the temperature at a desired level can prevent hydrate and/or wax formation and avoid expensive shut-downs.

The invention claimed is:

1. A method of monitoring a subsea pipeline system connecting one or more wells to a floating production system, wherein the subsea pipeline system is at least partially flexible, the method comprising:

installing a continuous optical fibre distributed sensor as part of the subsea pipeline system, using the continuous optical fibre distributed sensor to provide a distributed measurement of temperature, vibration, pressure or strain, or any combination thereof along at least a part of the subsea pipeline system;

making a discrete measurement of the flow rate in the subsea pipeline system or at the surface on the floating production system;

using a computer-based program to:

segment the at least part of the subsea pipeline system into a plurality of pipeline system sections;

plot the distributed measurement of temperature, vibration, pressure or strain with the plurality of pipeline system sections;

combine the distributed measurement for the plurality of pipeline system sections and the discrete measurement to predict the actual condition of the fluid or the subsea pipeline system;

feed-back a system model with the distributed measurement of temperature, vibration, pressure or strain;

use the system model to predict behavior of the subsea pipeline system; and use the predicted behavior of the subsea pipeline system to determine operation control parameters of the subsea pipeline system, including heating zones of the subsea pipeline system, shut-down/cool-down periods, choke positions and tension in anchor chains.

2. A method as claimed in claim 1, wherein the system model used the distributed measurement of temperature, vibration, pressure or strain to estimate fatigue in the subsea pipeline system, or a likelihood of hydrate or wax deposits at locations in the subsea pipeline system.

3. A method as claimed in claim 1, wherein the step of installing a continuous optical fibre distributed sensor comprises embedding the optical fibre within the wall of the subsea pipeline system, strapping the optical fibre to the inner or outer wall of the subsea pipeline system, or pumping the optical fibre into a conduit in the subsea pipeline system.

4. A method as claimed in claim 1, comprising using Brillouin backscatter measurements to provide distributed strain and temperature measurements.

5. A method as claimed in claim 1, comprising using coherent Rayleigh noise for vibration monitoring.

6. A method as claimed in claim 1, comprising feed-back the distributed into the system model for prediction and control in real-time.

7. A method as claimed in claim 1 for use in a flow assurance programme.

8. A method as claimed in claim 1 for use in a marine structural integrity programme.

9. A subsea pipeline system for connecting one or more wells to a floating production system, wherein the subsea pipeline system comprises:

at least one partially flexible pipeline;

a continuous optical fibre distributed sensor installed as part of the subsea pipeline system for providing a distributed measurement of temperature, vibration or strain or combinations thereof along at least a part of the subsea pipeline system;

flow rate sensors in the subsea pipeline system and/or at the surface of the floating production system; and a computer medium with a computer-based program to:

segment the at least part of the subsea pipeline system into a plurality of pipeline system sections;

plot the distributed measurement of temperature, vibration, pressure or strain with the plurality of pipeline system sections;

combine the distributed measurement for the plurality of pipeline system sections and the discrete measurement to predict the actual condition of the fluid or the subsea pipeline system;

feed-back a system model with the distributed measurement of temperature, vibration, pressure or strain;

use the system model to predict behavior of the subsea pipeline system; and use the predicted behavior of the subsea pipeline system to determine operation control parameters of the subsea pipeline system, including heating zones of the subsea pipeline system, shut-down/cool-down periods, choke positions and tension in anchor chains.

10. A subsea pipeline system as claimed in claim 9, wherein the at least one partially flexible pipeline is a flexible riser or subsea flowline.

11. A pipeline system as claimed in claim 9, wherein the optical fibre distributed sensor uses Raman backscattered Stokes and anti-Stokes measurements for temperature determination, Brillouin backscatter for temperature and strain determination, or coherent Rayleigh noise for vibration monitoring.

12. A pipeline system as claimed in claim 9, wherein the optical fibre distributed sensor is deployed in a U-shaped configuration with both ends located at or near the surface end of the at least one partially flexible pipeline.

13. A pipeline system as claimed in claim 9, wherein the optical fibre distributed sensor is embedded within the wall of the at least one partially flexible pipeline, strapped to the inner or outer wall of the at least one partially flexible pipeline, or pumped into a conduit in the at least one partially flexible pipeline.

* * * * *